US008752835B2

(12) United States Patent
Hashiuchi

(10) Patent No.: US 8,752,835 B2
(45) Date of Patent: Jun. 17, 2014

(54) PILLOW BLOCK FOR FEED ROLLER, AND FEEDING APPARATUS, IMAGE FORMING APPARATUS, AND IMAGE PROCESSING APPARATUS USING THE PILLOW BLOCK

(71) Applicant: Kohji Hashiuchi, Kanagawa (JP)

(72) Inventor: Kohji Hashiuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/845,477

(22) Filed: Mar. 18, 2013

(65) Prior Publication Data

US 2013/0241142 A1 Sep. 19, 2013

(30) Foreign Application Priority Data

Mar. 19, 2012 (JP) ..... 2012-062207

(51) Int. Cl.
*B65H 5/02* (2006.01)

(52) U.S. Cl.
USPC ..... 271/273; 198/860.1

(58) Field of Classification Search
USPC ..... 271/109, 117, 273; 198/860.1; 384/252, 384/256
See application file for complete search history.

(56) References Cited

U.S. PATENT DOCUMENTS

| | | | | |
|---|---|---|---|---|
| 3,504,954 | A * | 4/1970 | Robson | 384/252 |
| 5,413,638 | A * | 5/1995 | Bernstein et al. | 118/620 |
| 7,621,529 | B2 * | 11/2009 | Okazawa et al. | 271/274 |
| 8,070,365 | B2 * | 12/2011 | Hoppert | 384/535 |
| 2004/0017461 | A1 | 1/2004 | Saito | |
| 2011/0064493 | A1 | 3/2011 | Muramatsu et al. | |

FOREIGN PATENT DOCUMENTS

| | | |
|---|---|---|
| JP | 4027166 | 12/2007 |
| JP | 2011-085659 | 4/2011 |

* cited by examiner

*Primary Examiner* — Michael McCullough
(74) *Attorney, Agent, or Firm* — Cooper & Dunham LLP

(57) ABSTRACT

A pillow block supporting a feed roller includes a pillow block main body; a wedge body adjusting a height position of the pillow block main body; and a bracket adjustably installing the pillow block main body in a sheet feeding direction on a mounting surface. Further, the pillow block main body includes a reception part to support the feed roller, a concave part though which the wedge body is inserted, and the bracket is temporarily fixed to the mounting surface. Further, the wedge body pushes up the height position of the pillow block main body upon being inserted into the concave part to determine the position of the reception part so that the reception part supports the feed roller from below.

9 Claims, 9 Drawing Sheets

PILLOW BLOCK FOR FEED ROLLER, AND FEEDING APPARATUS, IMAGE FORMING APPARATUS, AND IMAGE PROCESSING APPARATUS USING THE PILLOW BLOCK

CROSS-REFERENCE TO RELATED APPLICATIONS

The present application claims priority under 35 U.S.C. §119 to Japanese Patent Application No. 2012-062207 filed Mar. 19, 2012, the entire contents of which are hereby incorporated herein by reference.

BACKGROUND OF THE INVENTION

1. Field of the Invention

The present invention generally relates to an image forming apparatus such as a multi-function peripheral including two or more functions selected from facsimile, printer, and copier functions, and an image processing apparatus such as an image reading apparatus including a scanner function. More particularly, the present invention relates to a pillow block supporting a feed roller, having a round bar shape, to feed a wide-width sheet; and a feeding apparatus, an image forming apparatus, and an image processing apparatus including the pillow block.

2. Description of the Related Art

As an image forming apparatus and an image processing apparatus that handle a wide-width sheet-like recording medium, there has been known an apparatus in which a paper, a sheet, or a sheet-like recording medium (hereinafter collectively referred to as a "sheet") is fed by a feed roller, so that an image is formed on the sheet or an image on the sheet is read.

In this type of the image forming apparatus and the image processing apparatus, a sheet on the platen is sandwiched between the feed roller on the lower side and a driven roller on the upper side at the grip section thereof, so that the sheet is fed in the direction orthogonal to the axle direction of the feed roller by the rotation of the feed roller having a round bar shape disposed at the lower side of the sheet. Simultaneously, for example, while the sheet is fed by the feed roller, characters may be printed on the sheet in the direction orthogonal to the feeding direction of the sheet near the feed roller.

References may be made to Japanese Laid-open Patent Publication No. 2011-085659 and Japanese Patent No. 4027166.

SUMMARY OF THE INVENTION

According to an aspect of the present invention, a pillow block to be installed to fit with a feed roller, which feeds a recording medium, to support the feed roller, includes a pillow block main body; a wedge body adjusting a height position of the pillow block main body; and a bracket adjustably installing the pillow block main body in a recording medium feeding direction on a mounting surface on which the pillow block is to be mounted.

Further, the pillow block main body includes a reception part that is disposed on an upper part of the pillow block main body and is open on an upper side thereof so as to support the feed roller.

Further, the pillow block main body further includes a concave part, so that the wedge body is inserted into the concave part.

Further, the bracket is temporarily fixed to the mounting surface in a manner such that the position of the bracket in the recording medium feeding direction is adjustable.

Further, the wedge body pushes up the height position of the pillow block main body upon being inserted into the concave part to determine the position of the reception part so that the reception part supports the feed roller from below.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In most image forming apparatuses or image processing apparatuses handling a wide-width sheet, a feed roller made of a relatively long axle having a round bar shape and a wide width extending in the direction orthogonal to the sheet feeding direction so as to cover the entire width of the sheet is used. However, when the feed roller becomes long, the feed roller may be deflected because of the pressure applied by a driven roller that is disposed on the upper side of and sandwiches the sheet with the feed roller.

Especially, the deflection of the feed roller is more likely to be increased in the middle part of the feed roller in the longitudinal direction thereof. To reduce such deflection, there has been known a technique in which a pillow block is disposed in the middle part of the feed roller. However, depending on, for example, the surface accuracy of the mounting surface (e.g., platen stay) on which the pillow block is mounted, the pillow block is more likely to be moved downward and may not support the feed roller so as to fail to maintain not only the straightness of the feed roller but also the straightness of the driven roller. As a result, the sheet may be skewed or wrinkled.

The present invention is made in light of the above conventional problem, and may provide a pillow block so as to, for example, more reliably maintain the straightness of the feed roller in an image forming apparatus or an image processing apparatus having the pillow block in the middle of the feed roller.

First Embodiment

A first embodiment of the present invention is described with reference to the drawings.

Figure 1:
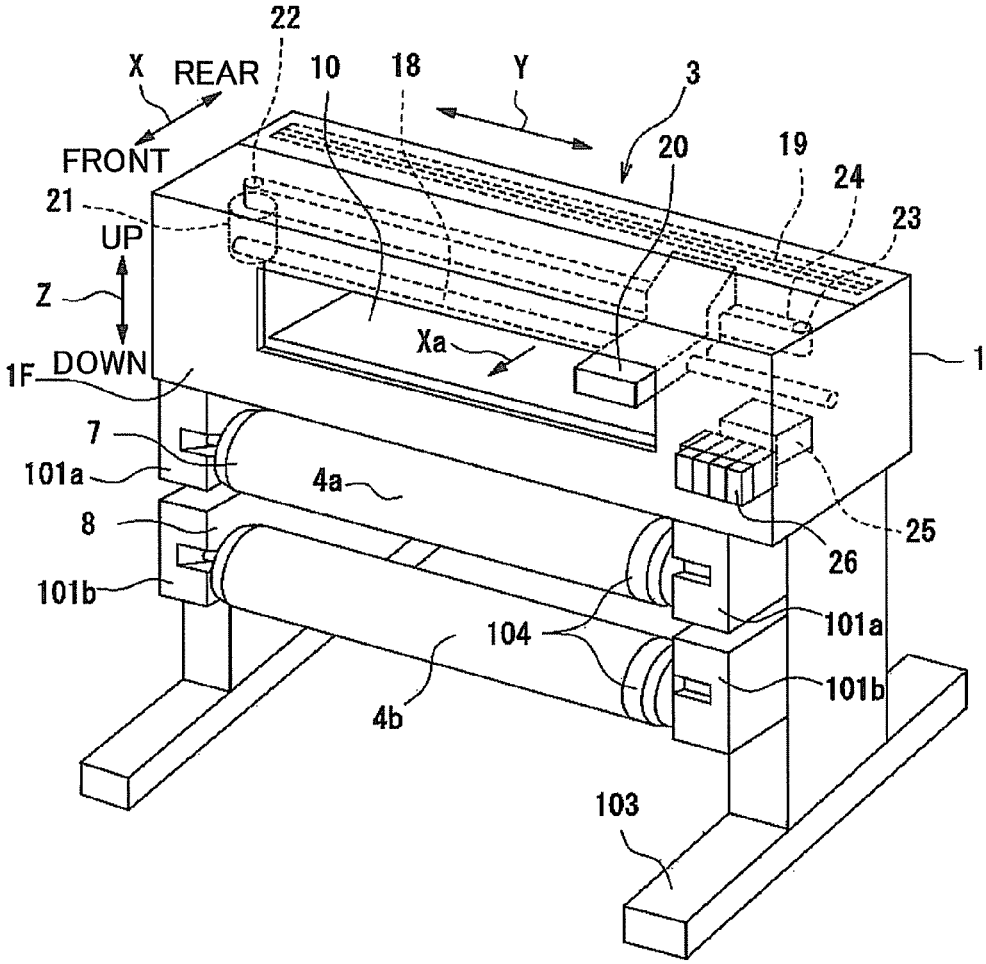
FIG. 1 is a schematic perspective view of an example image forming apparatus to which a pillow block according to an embodiment of the feed roller may be applied.
Figure 2:
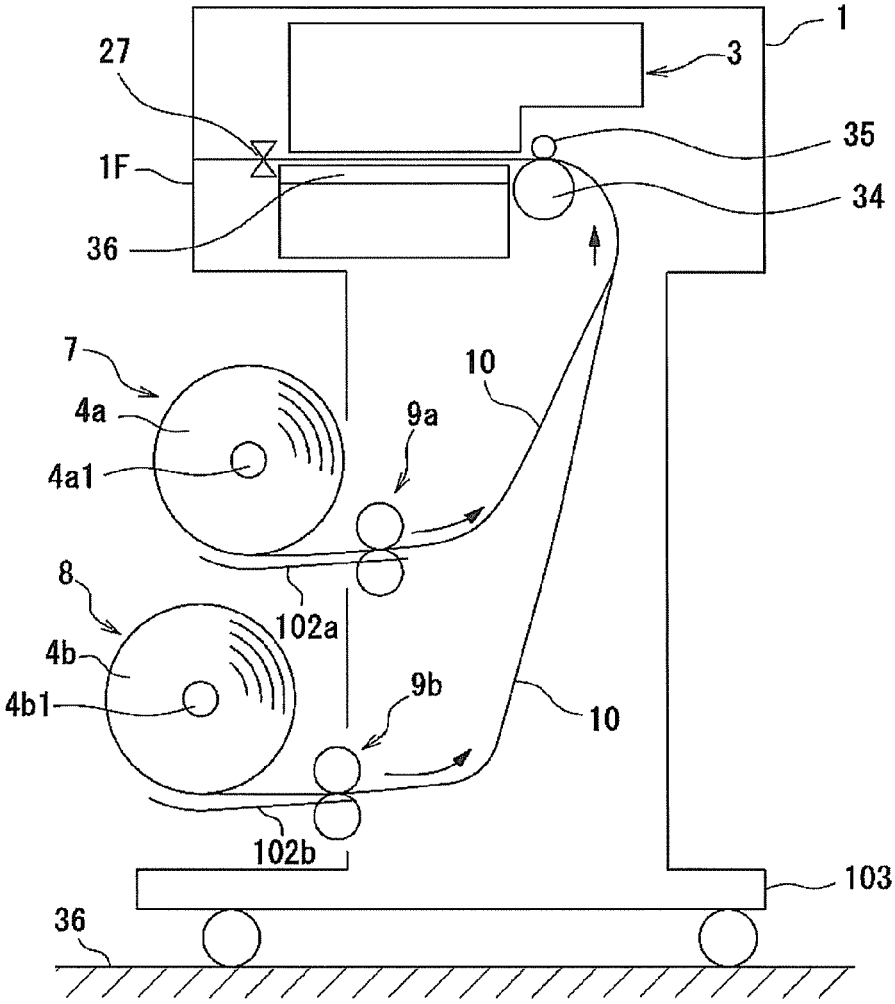
FIG. 2 is a cut-open view of the image forming apparatus of FIG. 1.

First, with reference to FIGS. 1 and 2, an example entire configuration and a main part configuration of an image forming apparatus according to an embodiment and operations thereof are described. In the arrowed X (front-back) direction which is orthogonal to the arrowed Z (up-down) direction, it is assumed that the left side corresponds to a front side 1F and the right side corresponds to a rear side. The arrowed Y direction which is orthogonal to both arrowed X and Z directions corresponds to the main scanning direction or sheet width direction (see FIG. 1).

Here, an image forming part 3 employs an inkjet recording method, so that an image is formed therein. As schematically illustrated in FIG. 2, it is assumed that this inkjet recording apparatus is a serial type inkjet recording apparatus. However, it should be noted that the present invention is not limitedly applied to this type of image forming apparatus.

The image forming apparatus includes spool pillow block stands 101*a* and 101*b* that support respective sheet rolls 4*a* and 4*b* so that the sheet 10 may be provided from the sheet rolls 4*a* and 4*b*. In the example, the number of the sheet rolls is two. However, the number of the sheet rolls may be one or three or more in this embodiment.

Further, in the image forming part 3 of the apparatus main body 1, there are provided a guide rod 18 and a guide rail 19 which are bridged between side plates (not shown). The guide rod 18 and the guide rail 19 slidably support a carriage 20 in the main scanning Y direction. The carriage 20 includes recording heads (not shown) that eject respective black (K), yellow (Y), magenta (M), and cyan (C) ink droplets. Those recording heads are integrally equipped with sub tanks that supply respective color inks thereto.

To slidably move the carriage 20 in the main scanning Y direction, there is provided a main scanning mechanism. The main scanning mechanism includes a drive motor 21, a drive pulley 22, a driven pulley 23, and an endless belt 24. The drive motor 21 is disposed on one side (left upper side in FIG. 1) in the main scanning Y direction. The drive pulley 22 disposed above the drive motor 21 is driven to rotate by the rotation of the output shaft of the drive motor 21. The driven pulley 23 is disposed on the other side in the main scanning Y direction. The endless belt 24 is stretched between the drive pulley 22 and the driven pulley 23.

The driven pulley 23 is biased in an outward direction (i.e., in the direction to be separated from the drive pulley 22) by a tension spring (not shown). A part of the endless belt 24 is fixed to a belt fixing part of the carriage 20, so that the carriage 20 may be moved in the main scanning Y direction by the rotation (movement) of the endless belt 24.

Further, to detect the position of the carriage 20 in the main scanning Y direction, an encoder sheet (not shown) is provided along the main scanning Y direction. On the other hand, an encoder sensor (not shown) is provided on the carriage 20, so that the encoder sensor reads the data on the encoder sheet.

A sheet 10 is fed from the upper roller sheet 4*a* or the lower roller sheet 4*b* into a recording area which is a part of a main scanning area of the carriage 20. More specifically, the sheet 10 is fed into the recording area by a feeding unit, which includes a roller pair 9*a* or 9*b*, a resist roller 34, which is an axle member having a round bar shape, and plural resist pressure rollers 35 disposed in the axial direction of the resist roller 34.

Further, the sheet 10 is intermittently fed in the sub scanning direction (arrowed Xa direction in FIG. 1 (i.e., front direction of the X (front-back) direction)) orthogonal to the main scanning Y direction. The sheet 10 is guided by a platen 36 which faces the carriage 20. A suction fan (not shown) is provided under the platen 36, so that the sheet 10 is held to the platen via a vacuum hole formed on the platen 36.

Further, a maintenance and recovery mechanism 25 to maintain and recover the recording heads in the carriage 20 is disposed on one end (right lower side in FIG. 1) of the main scanning area. Further, a main cartridge 26, which accommodates corresponding color ink to be supplied to the sub tanks of the respective recording heads, is detachably provided in the apparatus main body 1. Further, as illustrated in FIG. 2, a cutter 27 is provided as a sheet cutter so as to cut the sheet 10, on which an image is recorded (formed) in the image forming part 3, to have a desired length.

The cutter 27 is driven to cut the sheet 10 to have the desired length by a known mechanism, in which the cutter 27 is fixed to a wire or a timing belt stretched between plural pulleys (one of which is rotated by a driven motor), so that the cutter 27 cuts the sheet 10 to have a desired length when the wire or the timing belt is moved in the main scanning Y direction.

Figure 3:
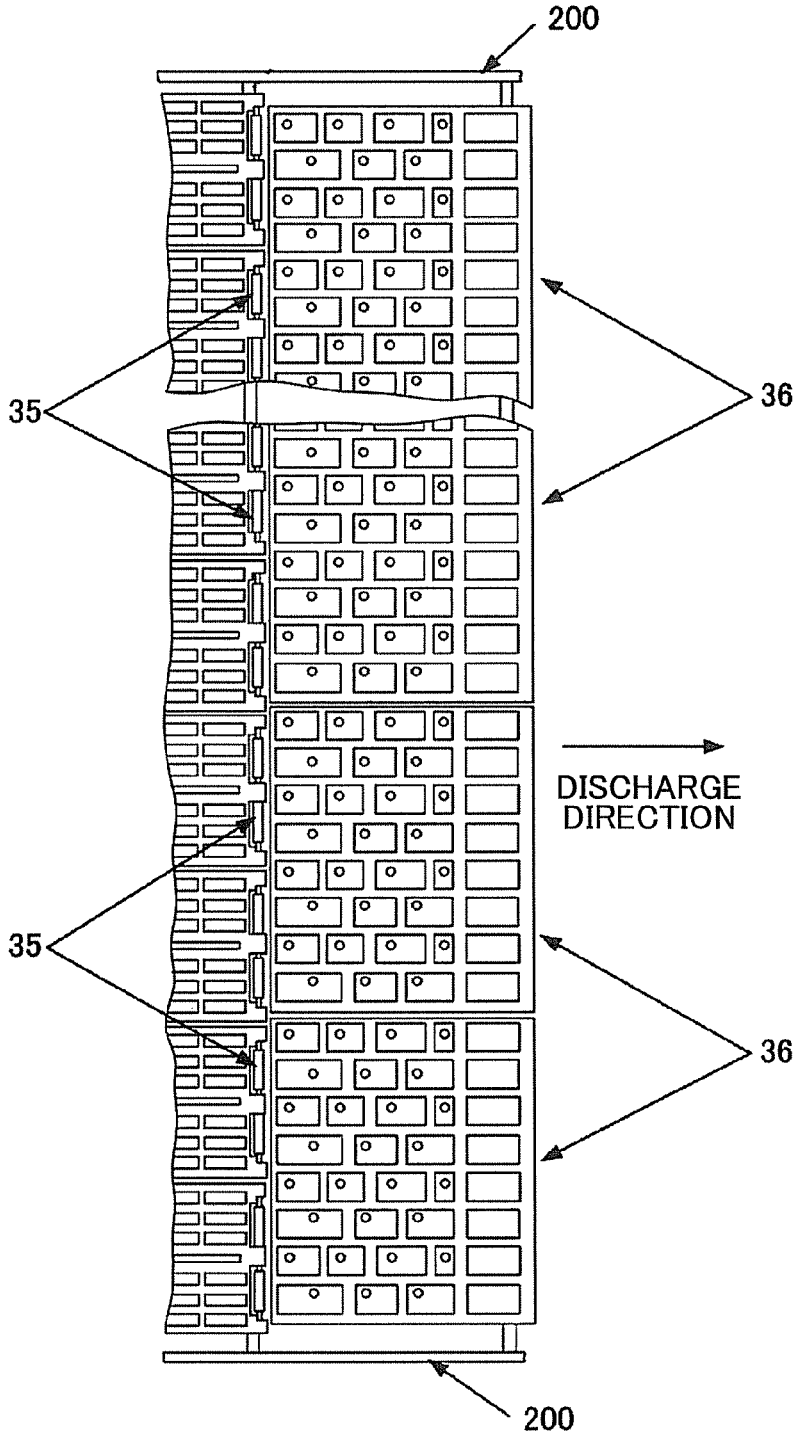
FIG. 3 is a drawing illustrating a guide rod, a resist roller, a resist pressure roller, a platen and the like provided in an apparatus main body of the image forming apparatus as illustrated in FIGS. 1 and 2.

FIG. 3 schematically illustrates the guide rod 18, the resist roller 34, the plural resist pressure rollers 35, the platen 36, and a side plate 200 of the apparatus main body 1 of the image forming apparatus as illustrated in FIGS. 1 and 2. The side plate 200 on the other side is not illustrated. The image forming part 3 (not shown) is provided above the platen 36. The arrow in FIG. 3 indicates the sheet feeding (discharge) direction (hereinafter may be referred to as a "sheet discharge direction").

As illustrated in FIG. 3, the platen 36 is not integrally formed but is divided into several parts which are arranged along the axial direction of the resist roller 34. Further, as may be described, the plural resist pressure rollers 35 are also arranged along the axial direction of the resist roller 34. For example, the plural resist pressure rollers 35 may be divided into groups, each of the groups including a pair of resist pressure rollers 35. Further, a pair of resist pressure rollers 35 may be separated from another pair of resist pressure rollers 35 by an appropriate distance (FIG. 3).

Figure 4A:
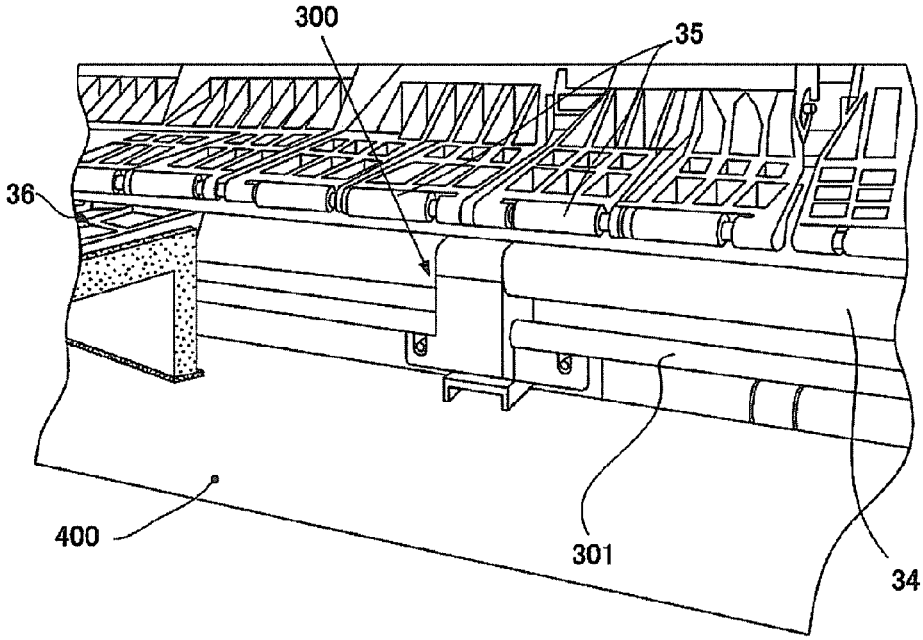
FIGS. 4A and 4B are perspective views of the part of FIG. 3 excluding the platen.
Figure 4B:
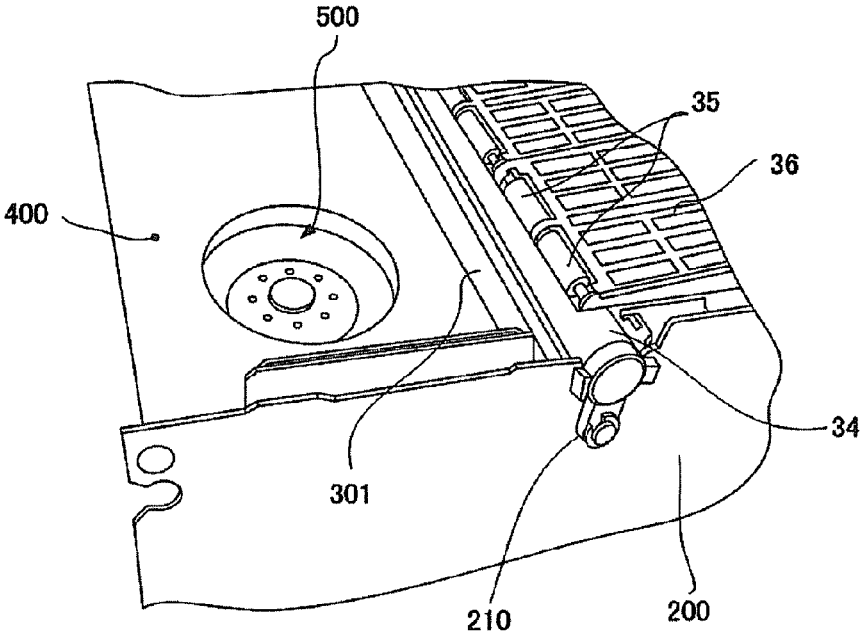

FIGS. 4A and 4B perspectively illustrate configurations similar to the configuration of FIG. 3, but a part of the platen 36 is removed. FIGS. 4A and 4B illustrate a pillow block 300, which supports the resist roller 34 serving as a feed roller and having a round bar shape, a guide axle 301 for the pillow block 300, a platen stay 400 on which the pillow block 300 is mounted, and a suction fan 500 provided on the side plate 200 side of the platen stay 400. The guide axle 301 is bridged (mounted) between two side plates 200.

Though it is not illustrated in FIG. 4B in detail, the side plates 200 includes elongated holes, which extend in the vertical (up and down) direction so as to provide tolerance in aligning the position of the guide axle 301 in the vertical direction; and a supporting member 210. In the example of the figure, the platen 36 and the guide axle 301 are supported by the supporting member 210. However, it should be noted that the present invention is not limited to this configuration.

Figure 5A:
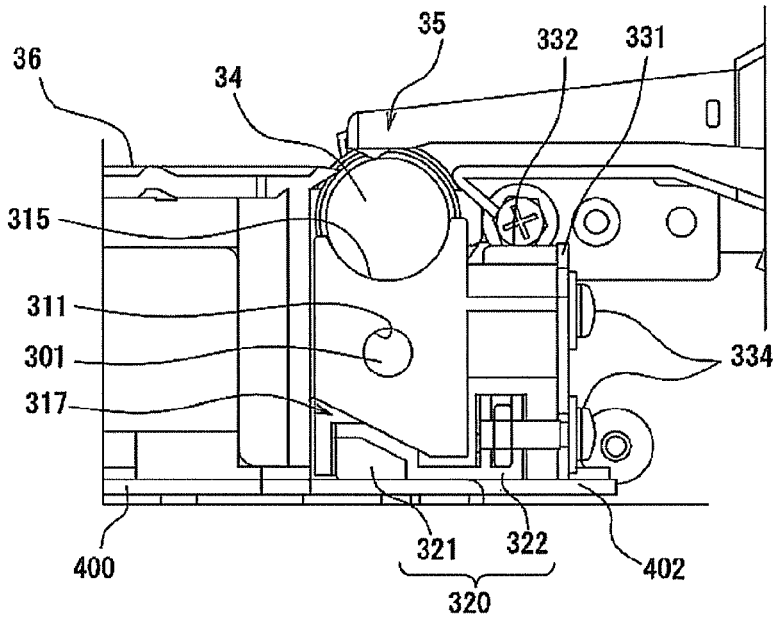
FIGS. 5A and 5B are cut-open views of a part of FIG. 3.
Figure 5B:
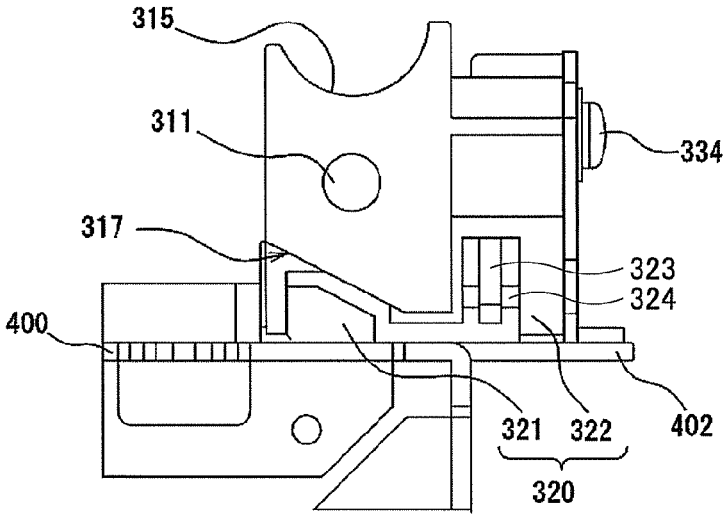
Figure 6A:
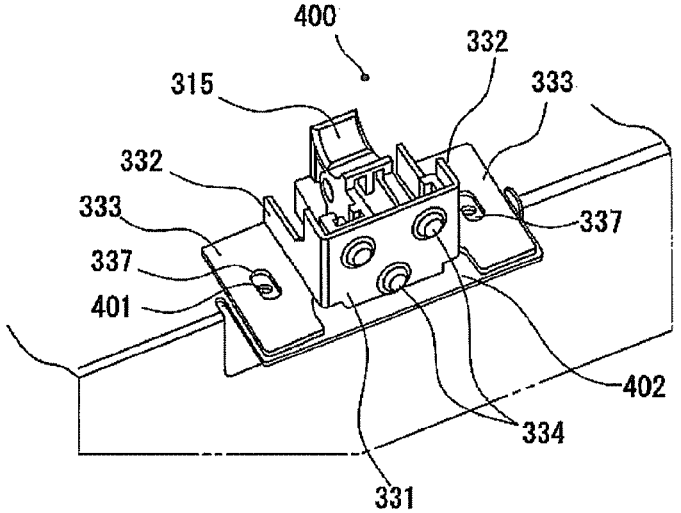
FIGS. 6A and 6B are perspective views of the parts of FIGS. 5A and 5B, respectively.
Figure 6B:
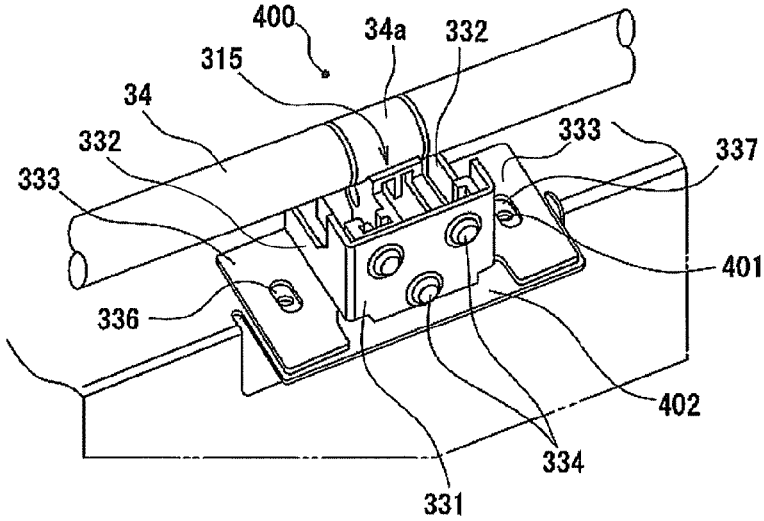
Figure 6C:
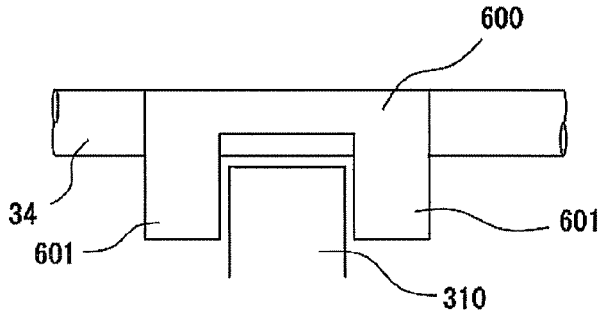
FIG. 6C schematically illustrates a jig for determining a position of the pillow block according to an embodiment.

FIGS. 5A and 5B are cut-open views cut in the sheet discharge direction. FIG. 5A illustrates a state where the pillow block 300 supports the resist roller 34, and FIG. 5B illustrates a state where the resist roller 34 is not mounted (removed). Further, FIGS. 6A and 6B are perspective views of the states of FIGS. 5A and 5B, respectively. FIG. 6C is a front view of a jig 600 placed on the resist roller 34 to determine the position of the pillow block 300 (relative to the resist roller 34).

As illustrated in the figures, the pillow block 300 includes a pillow block main body 310, a wedge body 320 for height adjustment of the pillow block main body 310, and a bracket 330 to fix the pillow block main body 310 to the platen stay 400. Here, the jig 600 includes protrusion parts 601 and 601 which are separated from each other in the axial direction of the resist roller 34, so that a reception part (described below) of the pillow block main body 310, which supports the resist roller 34, may be inserted (disposed) between the protrusion parts 601 and 601. By using the jig 600, the setting position of the pillow block main body 310 may be easily determined.

Figure 7:
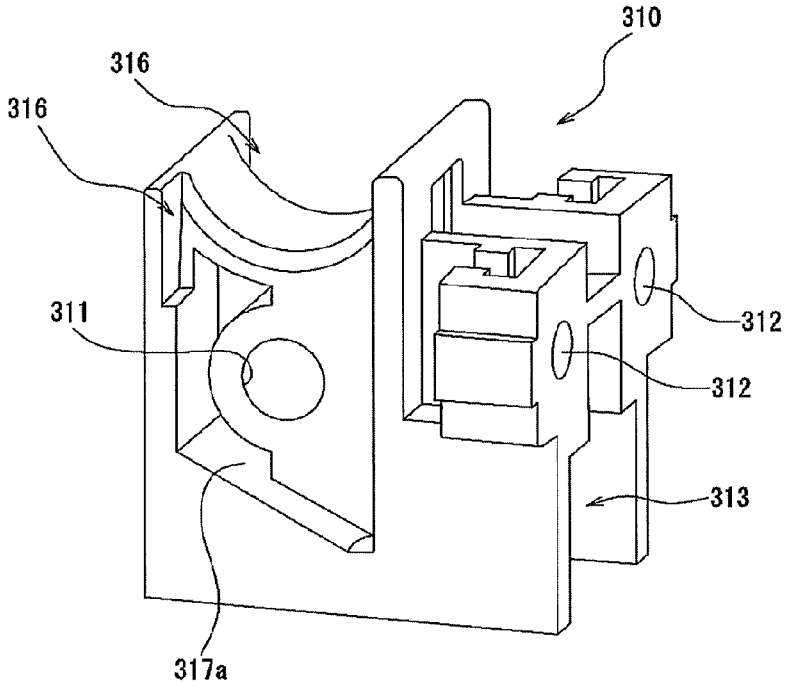
FIG. 7 is a rear perspective view of the part of FIG. 6A.
Figure 8:
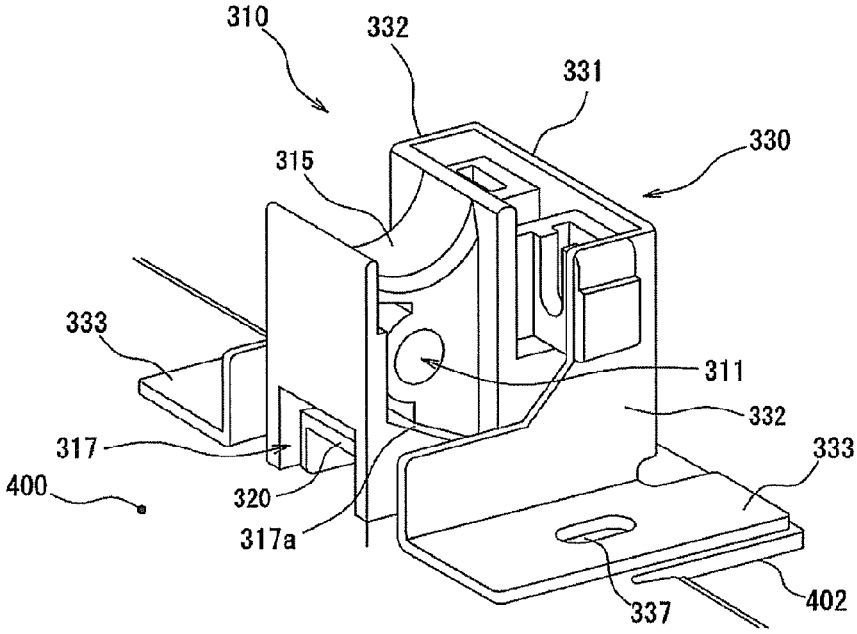
FIG. 8 is a perspective view of the pillow block according to an embodiment.

FIG. 7 is a perspective view of the pillow block main body 310. FIG. 8 is a rear perspective view (similar to the viewing direction of FIG. 4) of the state of the pillow block 300 of FIG. 6A. As is apparent from the figures, the pillow block main body 310 includes an opening 311, which is formed in substantially the center part thereof so that the guide axle 301 passes therethrough, screw holes 312 and 312, which are formed on a fixing surface thereof to be fixed to the bracket 330, and a concave part 313.

Further, the reception part 315 having an arc shape (the angular length of the arc is less than that of a semicircle so as to be open on the upper side, but the shape of the arc is not limited to that in the figures in the present invention) is formed on the upper side of the opening 311 so as to support the resist roller 34. Further, U-shaped grooves 316 and 316 are formed on the pillow block main body 310 so as to guide the jig 600.

On one side opposite to the side where the screw holes 312 and 312 are formed on the pillow block main body 310, that is on the surface facing the platen 36, a concave part 317 is formed on the pillow block main body 310, so that the wedge body 320 may be inserted into the concave part 317.

More specifically, the concave part 317 includes a ceiling surface 317*a* thereof which is inclined in a manner such that the height of the ceiling surface 317*a* on the side where the screw holes 312 and 312 are formed is lower than the opposite side.

As is apparent in FIGS. 5A and 5B, when the ceiling surface 317*a* is in contact with the upper surface of the wedge body 320, a wedge effect may occur, so that the position of the pillow block main body 310 in the vertical direction may be changed based on the (position of the) wedge body 320. It should be noted that the present invention is not limited to the configuration (structure) described in the description and the accompanying drawings. As long as the vertical position of the pillow block main body 310 may be changed by the wedge body 320, there may be various modification in the configuration (structure) without departing from the scope of the present invention.

The bracket 330 includes a front surface part 331, which is to be fixed with the pillow block main body 310 with screws, side surface parts 332 and 332, which face the respective side surfaces of the pillow block main body 310, and fixing surface parts 333 and 333 which are formed from the lower ends of the side surface parts 332 and 332 and extend outward at a right angle relative to the side surface parts 332 and 332.

Figure 9A:
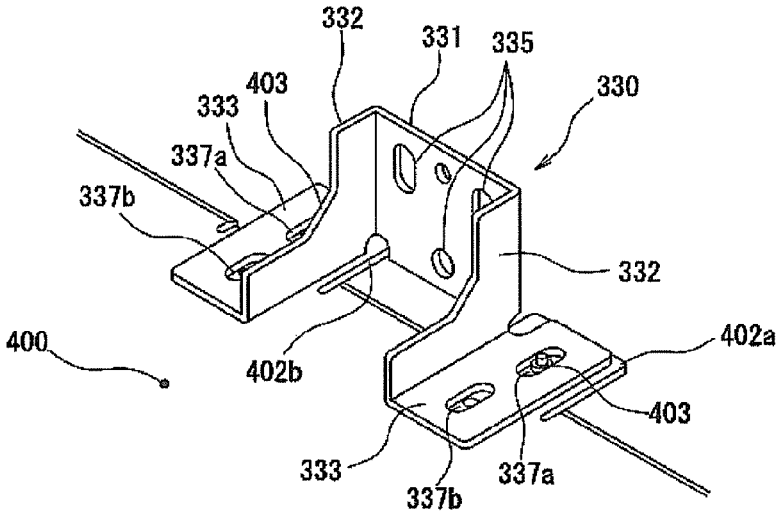
FIGS. 9A through 9D are perspective views of a pillow block according to another embodiment.
Figure 9B:
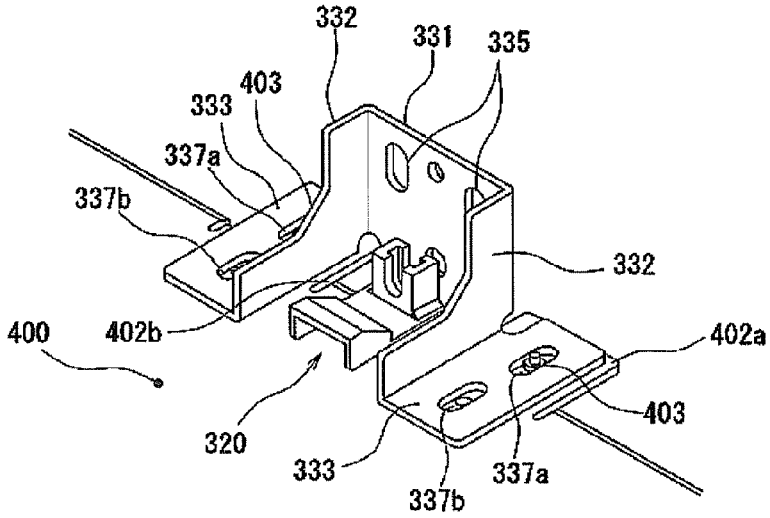
Figure 9C:
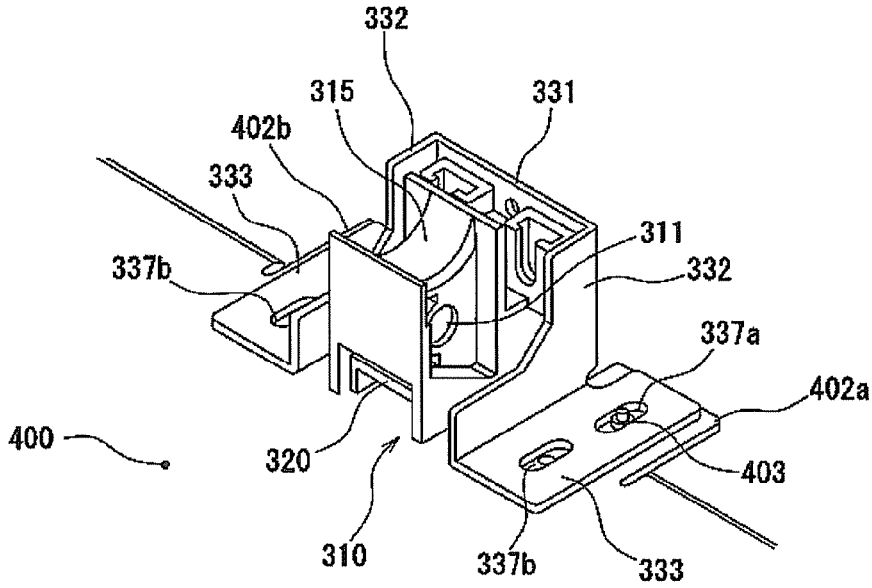
Figure 9D:
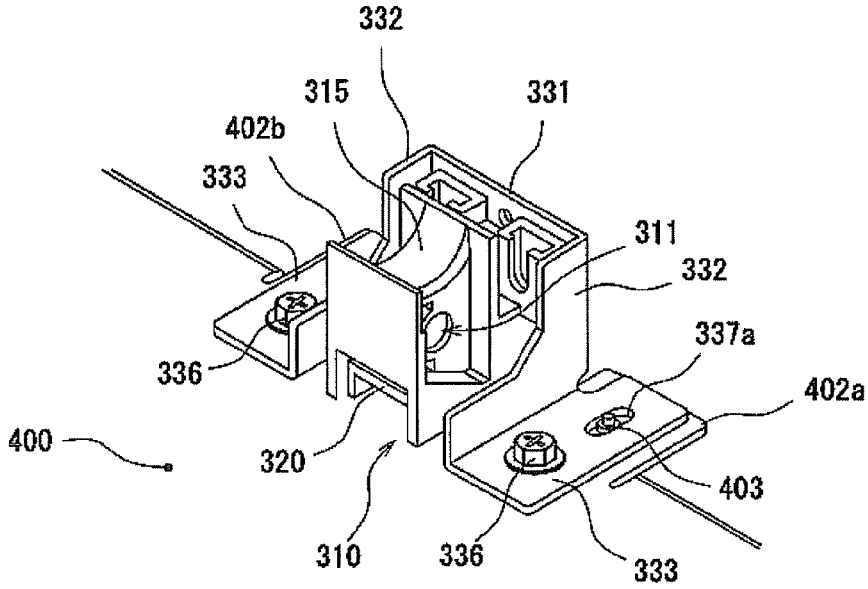

The front surface part 331 includes plural holes 335 (see FIG. 9A) (three holes in the example of the figures), so the screws 334 pass therethrough to fix the positions of the pillow block main body 310 and the wedge body 320. Here, it is assumed that the front surface part 331 on which the plural holes 335 are formed is the surface disposed at the position facing the pillow block main body 310 (more specifically, facing the concave part 317) (and facing the surface of the pillow block main body 310 where the screw holes 312 and 312 are formed).

Further, the number of the holes 335 may be determined based on the number of the screw holes 312 and 312 of the pillow block main body 310 and the wedge body 320. In the example of the figures, there are two holes 335 to fix the position of the block main body 310 and one hole 335 to fix the position of the wedge body 320. Preferably, the holes 335 may be elongated holes in the vertical direction so as to provide tolerance in determining the positions of the block main body 310 and the wedge body 320.

The side surface parts 332 and 332 have respective cutout parts so as not to prevent the passage of the guide axle 301 through the opening 311 formed on the pillow block main body 310 as illustrated in FIG. 8.

Further, the fixing surface parts 333 and 333 include respective elongated holes 337 so that screws 336 pass through the respective elongated holes 337 and screw holes 401 formed on the platen stay 400 to fix the position of the bracket 330 relative to the platen stay 400. Due to the elongated shape of the elongated holes 337, the fixed position of the bracket 330 relative to the platen stay 400 may be adjusted in the sheet discharge direction.

Further, in the example of the figures, to dispose the fixed position of the pillow block main body 310 just under the position of the resist roller 34, a longitudinal surface part of the platen stay 400 is cut out and the upper surface of the platen stay 400 is made to protrude in the direction opposite to the sheet discharge direction (the protruding part is illustrated by reference numeral 402).

However, such part may not be necessary depending on the shape, the position, or the structure of the platen stay 400. Therefore, the present invention is not limited to the structure disclosed in the description and the figures.

Referring back to FIGS. 5A and 5B, a shape and a structure of the wedge body 320 are described. As illustrated in the figures, the wedge body 320 includes a wedge part 321 and a standing part 322 which extends in the upright direction on the side of the wedge part 321 in the direction opposite to the sheet discharge direction. In the example of the figures, the wedge part 321 includes a hollow part (i.e., a rectangular (U-shaped) groove part in the cross section). However, it should be noted that the present invention is not limited to the structure of the wedge part 321.

Further, the standing part 322 includes a U-shaped groove 323 extending from the upper end of the standing part 322 down to the height substantially equal to the height of the upper surface of the wedge part 321. Further, in the vicinity of the lower end of the U-shaped groove 323, a screw part 324 is formed, so that the screw 334, which has passed through the hole 335 which is formed at the lowest position among the holes 335 formed on the front surface part 331 of the bracket 330, passes through the screw part 324.

Further, it should be noted that the present invention is not limited to the shape and the structure of the wedge body 320 described in the description and illustrated in the accompanying drawings. As long as the shape or the structure of wedge body 320 may affect the (position of the) pillow block main body 310, various shapes and structures may be employed as the wedge body 320 without departing from the scope of the present invention.

As described above, to install the pillow block 300 without affecting the straightness of the resist roller 34 serving as the feed roller so as to feed the sheet in straight, it may be desired to install the pillow block main body 310 of the pillow block 300 under the resist roller 34 extended between two side plates 200 so as not to affect the straightness of the resist roller 34.

To that end, for example, the pillow block main body 310 according to an embodiment may be installed based on the following procedure.

(1) The bracket 330 is temporarily fixed to the platen stay 400 using the elongated holes 337.

(2) At an appropriate position (specifically, in the substantial center) in the area surrounded by the side surface parts 332 and 332 of the bracket 330, the pillow block main body 310 and the wedge body 320 are placed in a manner such that the wedge body 320 is placed in the concave part 313 (in this state, the wedge body 320 does not push up the pillow block main body 310; it is another process to be performed later when the reception part 315 is in contact with the resist roller 34).

(3) The guide axle 301 is passed through the opening 311 of the pillow block main body 310. The ends of the guide axle 301 are supported between the two side plates 200. The reception part 315 of the pillow block main body 310 is placed just under the resist roller 34.

(4) The bracket 330 temporarily fixed to the platen stay 400 using the elongated holes 337 is moved, so that the front surface part 331 of the bracket 330 is in contact with the surface, where the screw holes 312 are formed, of the pillow block main body 310.

(5) The wedge body 320 is moved into the concave part 313 of the pillow block main body 310, so that the pillow block main body 310 along with the guide axle 301 is pushed up along the front surface part 331 of the bracket 330.

(6) The wedge body 320 is further moved, so that the resist roller 34 is moved into the reception part 315 of the pillow block main body 310 (in the example of the figures, a part 34*a* is formed on the surface of the resist roller 34 to prevent the resist roller 34 from being damaged due to the contact with the pillow block main body 310, so that the part 34*a* is in direct contact with the reception part 315 of the pillow block main body 310) (in this case, the pillow block main body 310 may be rotated around the guide axle 301 as the center of the rotation, so that the resist roller 34 is engaged with the reception part 315 of the pillow block main body 310).

(7) The reception part 315 supports the resist roller 34 while attention is paid so as not to affect the straightness of the resist roller 34

(8) While maintaining the state where the front surface part 331 of the bracket 330 is in contact with the pillow block main body 310 (without changing the positions of the resist roller 34, the pillow block main body 310, and the wedge body 320) the screws 336, which are temporarily tightened, are formally (finally) tightened.

(9) Then, the screws 344 are inserted into the screw holes 312 and 312 of the pillow block main body 310 from the outside of the front surface part 331 of the bracket 330, and another screw 344 is inserted into the screw part 324 formed at the lower end of the U-shaped groove 323 of the wedge body 320, so that the positions of those elements may be fixed (however, when the screw 344 is inserted into the screw part 324 of the wedge body 320, attention is paid so as not to change the position of the wedge body 320, namely, the screw 344 is loosely tightened).

By doing this, it may become possible to not only adjust the position of the resist roller 34 in the vertical direction by the pillow block 300 but also support the resist roller 34 by the pillow block 300 without affecting the straightness of the resist roller 34 having been installed straightly.

As a result, it may become possible to set (maintain) the positions of the resist roller 34 and the resist pressure rollers 35 to be parallel to each other. Accordingly, it may become possible to prevent the occurrence of skewing or wrinkling of the sheet due to the resist roller 34.

Further, the reception part 315 of the pillow block 300 and the outer periphery surface of the resist roller 34 may be in contact with each other based on the movement of the pillow block main body 310 in the vertical direction, and the position of the pillow block main body 310 is fixed with the screw 334. Therefore, the pillow block 300 may be installed without being affected by the surface accuracy of the platen stay 400 which is the installation surface of the pillow block 300.

Namely, even if the surface accuracy is low (e.g., not sufficiently flat), the pillow block main body 310 may be pushed up by using the wedge body 320 so that the reception part 315 of the pillow block 300 is in contact with (kept close to) the outer periphery surface of the resist roller 34. Therefore, the low surface accuracy of the platen stay 400 may not cause significant problems for the pillow block 300 in the present invention.

Second Embodiment

FIGS. 9A through 9D are perspective views according to a second embodiment. The configuration in the second embodiment differs from that in the first embodiment in the fixing surface parts 333 and 333 of the bracket 330 and the cut out shape of the longitudinal surface part of the platen stay 400. Other parts of the configuration are substantially similar to each other, therefore, the repeated descriptions are omitted.

Namely, each of the fixing surface parts 333 and 333 of the bracket 330 includes two elongated holes 337*a* and 337*b*. Further, there are formed two the cut out shapes of the longitudinal surface part of the platen stay 400 so as to correspond to the two fixing surface parts 333 and 333 of the bracket 330 (the extending parts are indicated by the reference numerals 402*a* and 402*a*).

On the header side of the extending parts, namely on the center side in the direction opposite to the sheet discharge direction, position determining pins (decapitated head pins) 403 and 403 are provided so as to be engaged with the elongated holes 337*a*.

In this second embodiment, it may become easier to set (install) the bracket 330 on the platen stay 400 at an appropriate position in the sheet discharge direction. The holes 335 in this second embodiment are elongated holes as illustrated in FIGS. 9A through 9D. Obviously, it is preferable that the holes 335 formed on the bracket 330 in the first embodiment also are elongated holes.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A pillow block to be installed to fit with a feed roller, which feeds a recording medium, to support the feed roller, the pillow block comprising:

a pillow block main body;

a wedge body configured to adjust a height position of the pillow block main body; and a bracket configured to adjustably install the pillow block main body in a recording medium feeding direction on a mounting surface on which the pillow block is to be mounted, wherein the pillow block main body includes a reception part that is disposed on an upper part of the pillow block main body and is open on an upper side thereof so as to support the feed roller, wherein the pillow block main body further includes a concave part, so that the wedge body is inserted into the concave part, and an opening formed in substantially the center part of the pillow block main body, wherein the bracket is configured to be temporarily fixed to the mounting surface in a manner such that the position of the bracket is adjustable in the recording medium feeding direction and in a direction orthogonal to an axle direction of the feed roller, and wherein the wedge body is configured to push up the height position of the pillow block main body upon being inserted into the concave part to determine the position of the reception part so that the reception part supports the feed roller from below.

2. The pillow block according to claim 1, wherein the concave part includes an inclined ceiling, so that the height position of the pillow block main body is changed depending on a position where the inclined ceiling is in contact with an upper surface of the wedge body, and wherein the bracket includes elongated holes, so that the bracket is temporarily fixed to the mounting surface with screws in a manner such that the position of the bracket in the recording medium feeding direction is adjustable.

3. The pillow block according to claim 1, wherein the pillow block main body includes plural screw holes formed on a surface on a side opposite to the side of the concave part, and wherein the bracket includes plural screw holes on a surface that faces the surface on which the plural screw holes of the pillow block main body are formed to fix the pillow block main body and the wedge body inserted into the concave part of the pillow block main body.

4. The pillow block according to claim 1, wherein the bracket includes elongated holes to fix the bracket to the mounting surface and a pair of fixing surface parts to be fixed to the mounting surface, and wherein each of the pair of the fixing surface parts includes a pair of the elongated holes arranged in the recording medium feeding direction.

5. A feeding apparatus for feeding a recording medium, the feeding apparatus comprising:

the pillow block according to claim 1.

6. An image forming apparatus that feeds a recording medium by using the feeding apparatus according to claim 5.

7. An image processing apparatus that feeds a recording medium by using the feeding apparatus according to claim 5.

8. The pillow block according to claim 1, wherein the pillow block main body further includes an opening formed in substantially the center part of the pillow block main body.

9. A pillow block to be installed to fit with a feed roller, which feeds a recording medium, to support the feed roller, the pillow block comprising:

a pillow block main body;

a wedge body configured to adjust a height position of the pillow block main body; and a bracket configured to adjustably install the pillow block main body in a recording medium feeding direction on a mounting surface on which the pillow block is to be mounted, wherein the pillow block main body includes a reception part that is disposed on an upper part of the pillow block main body and is open on an upper side thereof so as to support the feed roller, wherein the pillow block main body further includes a concave part, so that the wedge body is inserted into the concave part, and an opening formed in substantially the center part of the pillow block main body, wherein the bracket is configured to be temporarily fixed to the mounting surface in a manner such that the position of the bracket is adjustable in the recording medium feeding direction and in a direction orthogonal to an axle direction of the feed roller, wherein the wedge body is configured to push up the height position of the pillow block main body upon being inserted into the concave part to determine the position of the reception part so that the reception part supports the feed roller from below, and wherein the pillow block main body is detachable from the bracket.

* * * * *